US009106037B2

(12) United States Patent
Lee et al.

(10) Patent No.: US 9,106,037 B2
(45) Date of Patent: Aug. 11, 2015

(54) SOCKET HAVING ROTARY PLUG STRUCTURE

(71) Applicant: POWERTECH INDUSTRIAL CO., LTD., New Taipei (TW)

(72) Inventors: Yu-Lung Lee, New Taipei (TW); Yu-Hsuan Chen, New Taipei (TW)

(73) Assignee: POWERTECH INDUSTRIAL CO., LTD., New Taipei (TW)

( * ) Notice: Subject to any disclaimer, the term of this patent is extended or adjusted under 35 U.S.C. 154(b) by 228 days.

(21) Appl. No.: 13/844,987

(22) Filed: Mar. 17, 2013

(65) Prior Publication Data

US 2014/0106624 A1 Apr. 17, 2014

(30) Foreign Application Priority Data

Oct. 12, 2012 (TW) ..... 101137854 A

(51) Int. Cl.

| | |
|---|---|
| ***H01R 39/00*** | (2006.01) |
| ***H01R 31/06*** | (2006.01) |
| ***H01R 35/04*** | (2006.01) |
| *H01R 105/00* | (2006.01) |
| *H01R 13/621* | (2006.01) |

(52) U.S. Cl.

CPC ..... *H01R 31/06* (2013.01); *H01R 31/065* (2013.01); *H01R 35/04* (2013.01); *H01R 13/6215* (2013.01); *H01R 2105/00* (2013.01)

(58) Field of Classification Search

USPC ..... 439/21, 11, 13, 24, 27, 640

IPC ..... H01R 39/64,39/00, 39/643, 2103/00, H01R 35/04, 35/02, 31/06

See application file for complete search history.

(56) References Cited

U.S. PATENT DOCUMENTS

| | | | | |
|---|---|---|---|---|
| 5,775,921 | A | 7/1998 | Chou | |
| 7,311,533 | B1 * | 12/2007 | Lin et al. | 439/131 |
| 7,381,059 | B2 * | 6/2008 | Wong | 439/22 |
| 7,914,292 | B2 | 3/2011 | Honda | |
| 7,946,852 | B2 * | 5/2011 | John | 439/21 |
| 8,096,817 | B2 * | 1/2012 | Lee et al. | 439/104 |
| 8,167,622 | B2 * | 5/2012 | Zhou | 439/21 |
| 8,197,260 | B2 * | 6/2012 | Wadsworth | 439/27 |

FOREIGN PATENT DOCUMENTS

| | | |
|---|---|---|
| TW | 519330 | 1/2003 |
| TW | 547837 | 8/2003 |
| TW | M346195 | 12/2008 |
| TW | M405106 | 6/2011 |
| TW | M435772 | 8/2012 |

* cited by examiner

*Primary Examiner* — Hien Vu

(74) *Attorney, Agent, or Firm* — Guice Patents PLLC

(57) ABSTRACT

The present invention relates to a socket having rotary plug structure which comprises a housing and a rotary plug exposed outside the housing. At least a first socket is coupled to the rotary plug thereby allowing an electric equipment to be inserted. The rotary plug includes a rotation part and a ground pin fastened in the rotation part. A fasten pin is formed in the rotation part, wherein the distanced defined from the center point of the ground pin to the center point of the fasten pin is 38.9 mm±10%. With the mentioned structure, the socket having rotary plug structure is enabled to be fastened onto a socket panel.

14 Claims, 6 Drawing Sheets

SOCKET HAVING ROTARY PLUG STRUCTURE

BACKGROUND OF THE INVENTION

1. Field of the Invention

The present invention relates to a socket, especially to a socket having rotary plug structure which can be rotated 90 degrees to the right or the left or rotated in 360 degrees and has a fasten pin for fastening the socket onto a socket panel.

2. Description of Related Art

Referring to FIG. 1, which is a schematic view showing the assembly of a conventional wall-mounted socket. As shown in FIG. 1, the assembly of a conventional wall-mounted socket often comprises a fixed plug 500 and at least a socket 510. The socket 510 has two electro blades 511, 512 and a ground pin 513, wherein the fixed plug 500 is inserted in a socket panel 550, the socket 510 can be inserted with a charger of an electric equipment, e.g. a mobile phone, thereby allowing the mobile phone to be charged.

However, the mentioned wall-mounted socket has following disadvantages: 1. the fixed plug 500 is not able to be rotated, so when the socket panel 550 is a horizontal type panel, the whole socket has to be rotated 180 degrees to the left to allow the fixed plug 500 to be inserted in the socket panel 550; 2 the fixed plug 500 is inserted and fasten on the socket panel 550 merely through the two electro blades 511, 512 and the ground pin 513, thus the fasten strength is obviously not sufficient enough; and 3. the wall-mounted socket cannot be used for accommodating a mobile phone.

The Taiwan Patent NO. M435772 has disclosed a mobile phone base type charger structure improvement, in which the charging connector of a mobile phone and the charger are integrated, and the charging connector and a AC plug are designed to be separately rotated, when in use, the AC plug and the charging connector can be rotated for being exposed, after the charging operation, the two connectors can be rotated for being folded, thereby providing convenience while being carried around.

However, the wall-mounted socket disclosed in the mentioned patent has following disadvantages: 1. the plug is inserted and fastened on the socket panel merely through the two electro blades and the ground pin, thus the fasten strength is obviously not sufficient enough; and 2. not being able to be used for accommodating a mobile phone.

In view of the disadvantages of conventional wall-mounted socket, the present invention provides a socket having rotary plug structure for improving the mentioned disadvantages.

SUMMARY OF THE INVENTION

One primary objective of the present invention is to provide a socket having rotary plug structure, in which a fasten pin is installed for fastening the socket onto a socket panel.

Another objective of the present invention is to provide a socket having rotary plug structure, in which an accommodation holder is provided, one end of the accommodation holder is formed with a stop sheet thereby allowing a hand-held communication device to be accommodated.

For achieving the above-mentioned objectives, the present invention provides a socket having rotary plug structure, which comprises: a housing and a rotary plug exposed outside the housing. At least a first socket is coupled to the rotary plug, thereby allowing an electric equipment to be inserted. The rotary plug includes a rotation part and a ground pin fastened in the rotation part. A fasten pin is formed in the rotation part, wherein the distanced defined from the center point of the ground pin to the center point of the fasten pin is 38.9 mm±10%.

The socket having rotary plug structure provided by the present invention comprises a housing and a rotary plug exposed outside the housing. A first socket is coupled to the rotary plug thereby allowing an electric equipment to be inserted. The rotary plug includes a rotation part and a live blade and a neutral blade fastened on the rotation part, wherein the distance defined from one side end of the live blade and the neutral blade to the edge of the rotation part is greater or equal to 4.0 mm.

For achieving the above-mentioned objectives, the present invention provides a socket having rotary plug structure, which comprises: a housing, at least an opening is formed on the housing, the top surface thereof is formed with a first lock hole, the bottom thereof is installed with a rotary plug exposed outside of the housing, the rotary plug is formed with a second lock hole at the location corresponding to the first lock hole; and at least a first socket, received in the housing and exposed outside the opening, coupled to the rotary plug thereby allowing an electric equipment to be inserted; wherein, the rotary plug further has a fasten part and a rotation part, wherein the fasten part is formed with a live protrusion, a neutral protrusion and a ground protrusion, the rotation part is combined with the fasten part and further installed with a live blade, a neutral blade and a ground pin, wherein the distance defined from the center point of the ground pin to the center point of the second lock hole is 10.5 mm.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
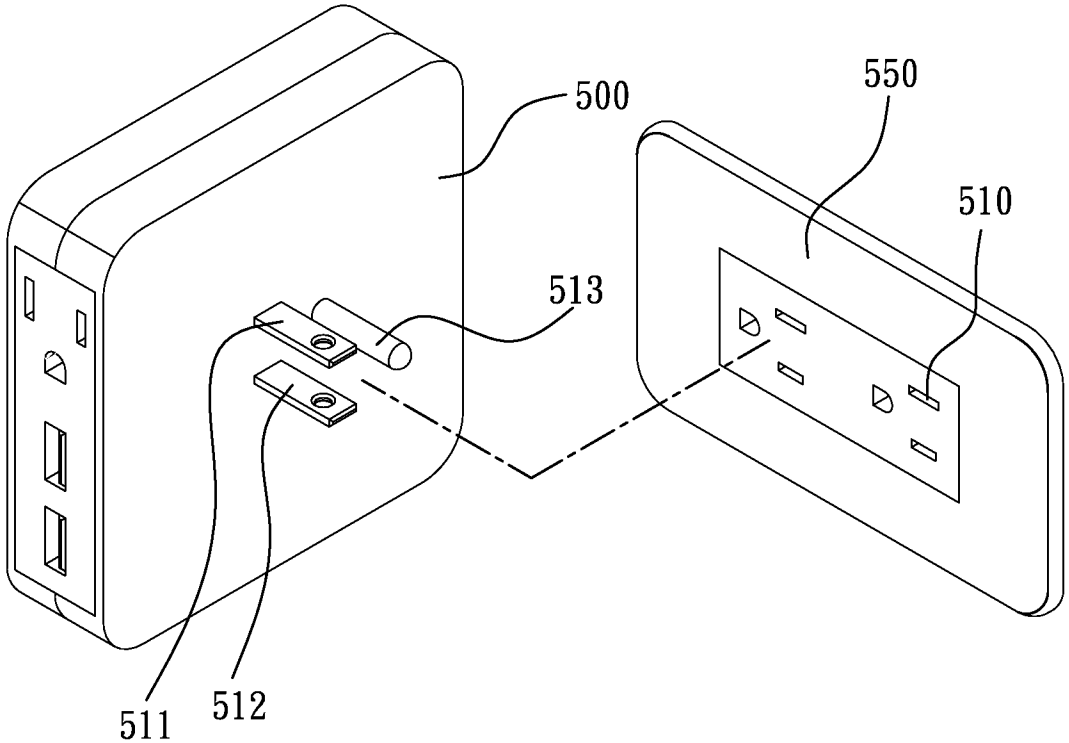
(PRIOR ART) FIG. 1
FIG. 1 is a schematic view illustrating the assembly of a conventional wall-mounted socket.
Figure 2:
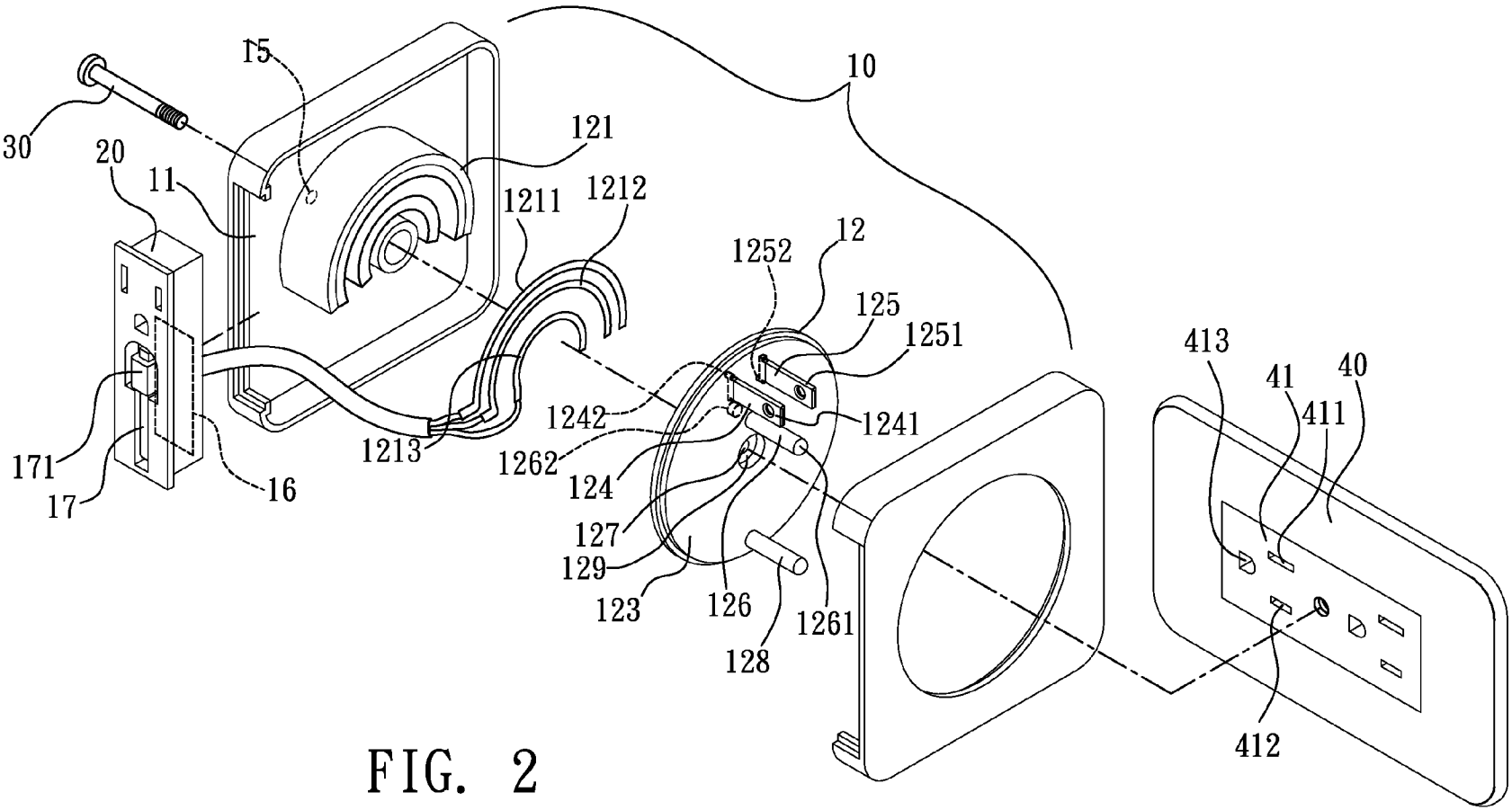
FIG. 2 is an exploded view illustrating the socket having rotary plug structure, according to one preferred embodiment of the present invention.
Figure 3:
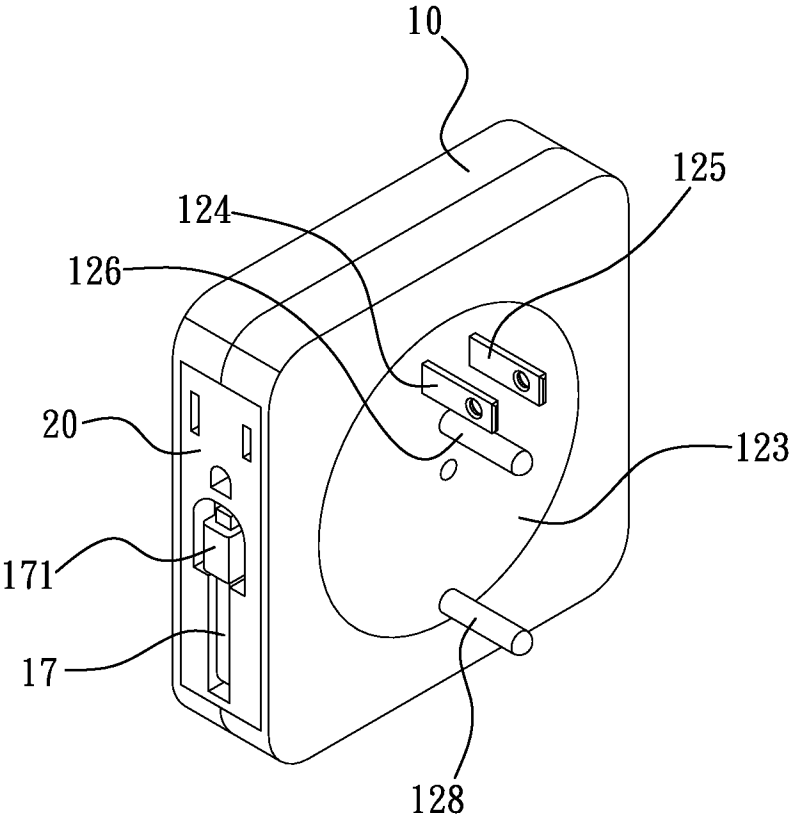
FIG. 3 is a schematic view illustrating the assembly of the socket having rotary plug structure, according to one preferred embodiment of the present invention.
Figure 4:
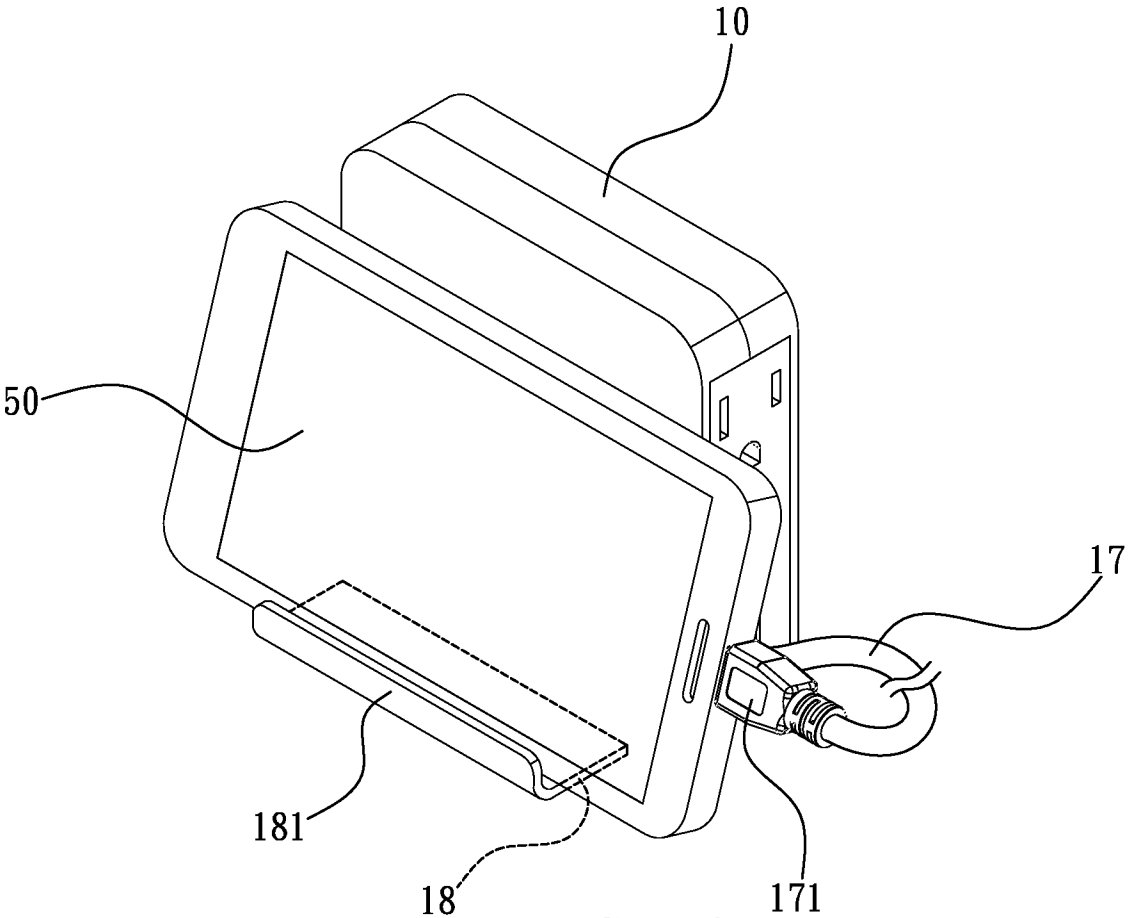
FIG. 4 is a schematic view illustrating the socket having rotary plug structure being installed with an accommodation holder allowing a hand-held communication device to be accommodated, according to one preferred embodiment of the present invention.
Figure 5:
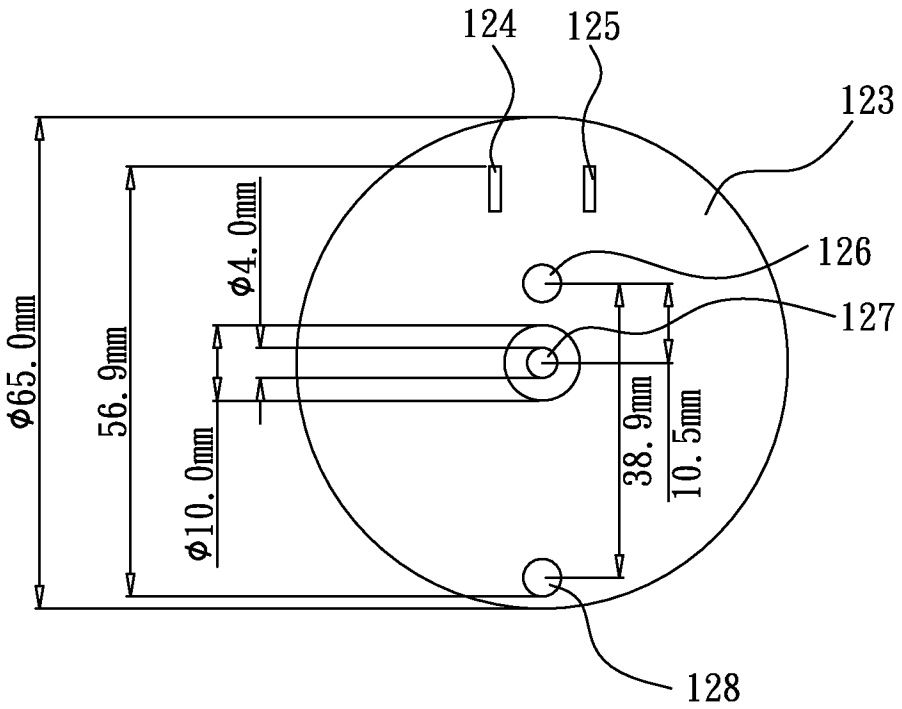
FIG. 5 is a schematic view illustrating the dimensions of components of the socket having rotary plug structure, according to one preferred embodiment of the present invention.
Figure 6:
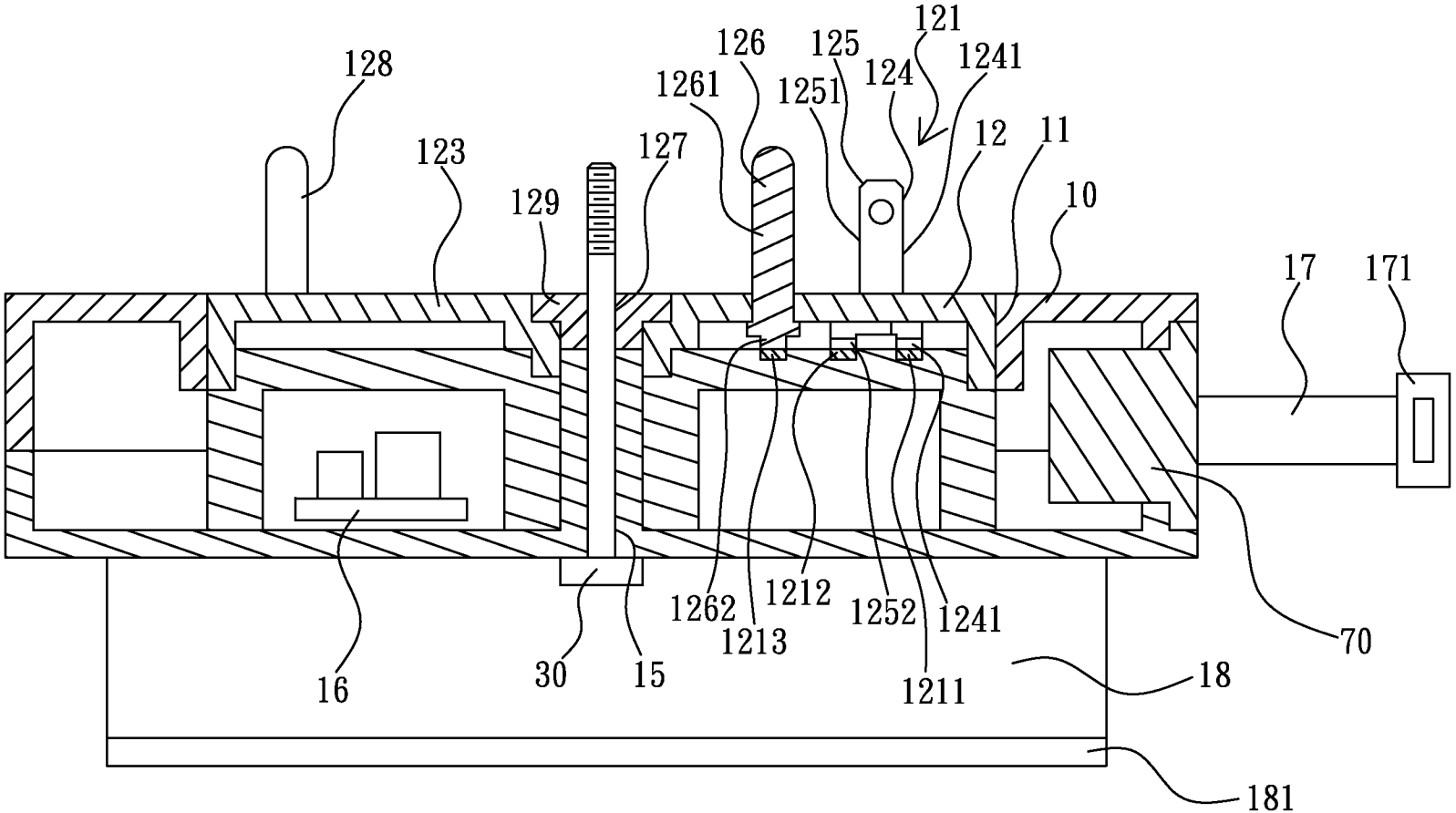
FIG. 6 is a cross sectional view showing the rotary plug, according to one preferred embodiment of the present invention.

Referring from FIG. 2 to FIG. 6, wherein FIG. 2 is an exploded view showing the socket or adaptor having rotary plug structure, according to one preferred embodiment of the present invention; FIG. 3 is a schematic view showing the assembly of the socket having rotary plug structure, according to one preferred embodiment of the present invention; FIG. 4 is a schematic view illustrating the socket having rotary plug structure being installed with an accommodation holder allowing a hand-held communication device to be accommodated, according to one preferred embodiment of the present invention; FIG. 5 is a schematic view illustrating the dimensions of components of the socket having rotary plug structure, according to one preferred embodiment of the present invention; and FIG. 6 is a cross sectional view showing the rotary plug, according to one preferred embodiment of the present invention.

As shown in figures, the socket or adaptor having rotary plug structure provided by the present invention at least includes: a housing 10; and at least a first socket 20.

The housing 10 is preferably made of an insulation material, e.g. but not limited to plastic, at least an opening 11 is formed on the housing, the bottom thereof is installed with a rotary plug 12 exposed outside the housing 10. Wherein, the rotary plug 12 is able to be rotated 90 degrees to the left or the right or rotated in 360 degrees; according to this embodiment, the arrangement of rotating 90 degrees to the left or the right is adopted for illustration and shall be seen as a limitation to the scope of the present invention.

The first socket 20 can be a conventional AC 110V 2-hole or 3-hole socket or a 220V 3-hole socket, and received in the housing 10 and exposed outside the opening 11, thereby allowing an electric equipment (not shown in figures) to be inserted for obtaining the electric power required for operation. Wherein, the quantity of the socket 20 is the same as the quantity of the opening 11.

The rotary plug 12 is further formed with a fasten part 121 and a rotation part 123, wherein the fasten part 121 is fastened in the housing 10 and formed with a first arc-shaped contact sheet 1211, a second arc-shaped contact sheet 1212 and a third arc-shaped contact sheet 1213; the rotation part 123 is combined with the fasten part 121 and further includes a live blade 124, a neutral blade 125 and a ground pin 126.

According to this embodiment, the rotation part 123 is formed as a round structure, what shall be addressed is that the structure can be designed with respect to the actual needs; for example, the design for the surface area can be smaller e.g. formed in a rectangular shape, or for having a more fashionable appearance thereby being formed in an triangular or other shapes such as star-like shape; in actual practice, the shape of the rotation part is not limited to the structure disclosed in this embodiment.

One end of the live blade 124 is formed with a blade part 1241 exposed outside the rotation part 123, the other end is formed with a live protrusion 1242 in the rotation part 123, the live protrusion 1242 is enabled to slide on the first arc-shaped contact sheet 1211 and be in contact with the first arc-shaped contact sheet 1211.

One end of the neutral blade 125 is formed with a blade part 1251 exposed outside the rotation part 123, the other end is formed with a neutral protrusion 1252 in the rotation part 123, the neutral protrusion 1252 is enabled to slide on the second arc-shaped contact sheet 1212 and be in contact with the second arc-shaped contact sheet 1212.

One end of the ground pin 126 is formed with a pin part 1261 exposed outside the rotation part 123, the other end is formed with a ground protrusion 1262 in the rotation part 123, the ground protrusion 1262 is enabled to slide on the third arc-shaped contact sheet 1213 and be in contact with the third arc-shaped contact sheet 1213.

In addition, the top surface of the housing 10 is further formed with a first lock hole 15, the rotary plug 12 is formed with a second lock hole 127 at the location corresponding to the first lock hole 15, thereby allowing a screw 30 to pass for being locked onto a socket panel 40, the socket panel 40 at least has two second sockets 41, each of the second sockets 41 is formed with a first blade hole 411, a second blade hole 421 and a pin hole 413.

Moreover, the rotary plug 12 is further provided with a fasten pin 128, in this embodiment, the fasten pin 128 is disposed at a side opposite to the ground pin 126, so the ground pin can be inserted into the pin hole of a first socket of the two second sockets 41 and the fasten pin 128 can be inserted in the pin hole 413 of a second socket of the two second sockets 41 of the socket panel 40, thereby fastening the socket having rotary plug structure of the present invention onto one of the two second sockets 41 of the socket panel 40.

According to the mentioned embodiment, the fasten pin 128 is disposed at a ground location opposite to the ground pin 126, i.e. corresponding to the two pin holes 413 of the two second sockets 41. However, in other embodiments, the arrangement can be altered, for example the fasten pin 128 can be formed at a location opposite to the first blade hole 411 or at a location opposite to the second blade hole 412; or two fasten pins 128 can be adopted and respectively corresponding to the first blade hole 411 and the second blade hole 412. Of course, the fasten pin 128 can also be formed at a location corresponding to the second lock hole 127 of the socket panel 40.

For enabling the socket having rotary plug structure of the present invention to be tightly fastened on the socket panel 40, the shape of the fasten pin 128 can be further designed, so the tail end which is inserted in the socket panel 40 is formed with a latch structure, e.g. but not limited to allow the tail end of the fasten pin 128 to be larger such that a tight latching can be achieved after the fasten pin 128 being inserted in the pin hole 413. Due to the tight latching, the force required for removing has to be greater, therefore the socket having rotary plug structure of the present invention can be prevented from being easily or accidentally released from the socket panel 40. The material of which the fasten pin 128 is made can be an electric conductive material, e.g. but not limited to metal, or a non electric conductive material, e.g. but not limited to plastic.

In addition, the housing 10 is further provided with a rectify circuit 16 having its one end being coupled to the rotary plug 12 for converting the input AV power into DC power for outputting.

Moreover, the housing 10 is further provided with a USB cable 17 having its one end being coupled to the output end of the rectify circuit 16 and the other end being installed with a USB plug 171. The USB plug 171 can be inserted in a hand-held communication device 50 and used for charging the hand-held communication device 50. The hand-held communication device 50 is e.g. but not limited to a mobile phone.

As shown in FIG. 4, one side of the housing 10 is further formed with an accommodation structure, e.g. but not limited to an accommodation holder 18, one end of the accommodation holder 18 is formed with a stop sheet 181 thereby allowing the hand-held communication device 50 to be accommodated. Referring to FIG. 4, the accommodation structure is formed at the front side of the housing; however, the accommodation structure being formed at other locations shall be within the scope of the present invention, such as being formed at a lateral side of the housing 10.

As shown in FIG. 5, which is a schematic view illustrating the dimensions of components of the socket having rotary plug structure, according to one preferred embodiment of the present invention. The diameter of the rotation part 123 is e.g. but not limited to 65.0 mm; for preventing the live blade 124 and the neutral blade 125 from loosening and falling, the distance defined from the right side end of the live blade 124 and the neutral blade 125 to the edge of the rotation part 123 is e.g. but not limited to be greater or equal to 4.0 mm; the distance defined from the left side end of the fasten pin 128 to the edge of the rotation part 123 is e.g. but not limited to be greater or equal to 4.0 mm; the distance defined from the center point of the ground pin 126 to the center point of the fasten pin 128 is e.g. but not limited to 38.9 mm; the distance defined from the center point of the ground pin 126 to the center point of the second lock hole 127 is e.g. but not limited to 10.5 mm; the diameter of the first lock hole 15 and the second lock hole 127 is e.g. but not limited to be greater or equal to 4.0 mm. Because of the product design, distance defined from the center point of the ground pin to the center point of the fasten pin can be 38.9 mm±10, 38.9 mm±5%, or even 38.9 mm±1%.

In addition, as shown in FIG. 2 and FIG. 6, according to the socket having rotary plug structure of the present invention, the center of the fasten part 121 can be further formed with a fasten ring 129, so when the rotary plug 12 is rotated, the fasten ring 129 is fixed and the rotation part 123 is rotated at the periphery of the fasten ring 129.

As such, with the aforesaid structure, the present invention can achieve: 1. the rotary plug 12 is enabled to be rotated 90 degrees to the right or the left or rotated in 360 degrees, thereby being applicable in the socket panel 40 arranged in various directions; 2. a fasten pin 128 is installed for fastening the socket 20 onto the socket panel 40; and 3. an accommodation holder 18 is provided, one end of the accommodation holder 18 is formed with a stop sheet 181 thereby allowing the hand-held communication device 50 to be accommodated.

As such, with the disclosed structure, the present invention can achieve: 1. the rotary plug 12 is enabled to be rotated 90 degrees to the right or the left or rotated in 360 degrees, thereby being applicable in the socket panel 40 arranged in various directions, and while being rotated, the fasten ring 129 is fixed, only the rotary plug 12 is enabled to be rotated; 2. a fasten pin 128 is installed for fastening the socket 20 onto the socket panel 40; and 3. an accommodation holder 18 is provided, one end of the accommodation holder 18 is formed with a stop sheet 181 thereby allowing the hand-held communication device 50 to be accommodated.

As what has been disclosed above, the socket having rotary plug structure of the present invention has following advantages: 1. the rotary plug is enabled to be rotated 90 degrees to the right or the left or rotated in 360 degrees, thereby being applicable in the socket panel arranged in various directions; 2. a fasten pin is installed for fastening the socket onto the socket panel; and 3. an accommodation holder is provided, one end of the accommodation holder is formed with a stop sheet thereby allowing the hand-held communication device to be accommodated. Therefore, the socket having rotary plug structure provided by the present invention is novel comparing to the prior arts.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A adaptor having rotary plug structure, comprising:
a housing;
a rotary plug, exposed outside a front of said housing;
at least a first socket, coupled to said rotary plug, thereby allowing an electric equipment to be inserted;
said rotary plug includes a rotation part, at least two terminals, and a ground pin fastened in said rotation part, wherein one end of said ground pin is exposed outside said housing, the other end is secured in said housing;
a non-electrically connected fasten pin formed at an adjacent edge of said rotation part and spaced apart from said ground pin, said ground pin and said fasten pin protrude outwardly from an outer surface of said rotation part;
wherein a distanced defined from a center point of said ground pin to a center point of said fasten pin is 38.9 mm±10%.

2. The adaptor having rotary plug structure as claimed in claim 1, further including an accommodation structure formed on said housing, wherein said accommodation structure is an accommodation holder for supporting a hand-held communication device.

3. The adaptor having rotary plug structure as claimed in claim 1, wherein a back surface of said housing is formed with a first lock hole, said rotary plug is formed with a second lock hole at the location corresponding to said first lock hole, a distance defined from a center point of said ground pin to a center point of said second lock hole is 10.5 mm.

4. The adaptor having rotary plug structure as claimed in claim 1, wherein a diameter of said rotary plug is 65.0 mm, and said at least two terminals of said rotary plug includes a live blade and a neutral blade fastened on said rotation part, said live blade and said neutral blade are spaced at least 4.0 mm from an outer periphery of said rotation part.

5. The adaptor having rotary plug structure as claimed in claim 1, further including a first lock hole formed on said housing and a second lock hole correspondingly formed on said rotation part of said housing, a screw is inserted through said first lock hole and said second lock hole and is connectable to a socket panel to selectively secure the housing to the socket panel, said socket panel at least includes two second sockets, each of said second sockets has a first blade hole, a second blade hole and a pin hole.

6. The adaptor having rotary plug structure as claimed in claim 5, wherein said ground pin is inserted in the pin hole of a first socket of the two second sockets of said socket panel and said fasten pin is inserted in the pin hole of a second socket of the two second sockets of said socket panel, said fasten pin is spaced at least 4.0 mm from an outer periphery of said rotation part.

7. The adaptor having rotary plug structure as claimed in claim 2, wherein said accommodation structure has a stop sheet thereby allowing a hand-held communication device to be supported.

8. The adaptor having rotary plug structure as claimed in claim 1, wherein a diameter of said first lock hole and a diameter of said second lock hole is 4.0 mm.

9. A adaptor having rotary plug structure, comprising:
a housing;
a rotary plug, exposed outside a front of said housing; and
at least a first socket, coupled to said rotary plug, thereby allowing an electric equipment to be inserted;
said rotary plug further includes a rotation part, a live blade, a neutral blade, and a ground pin fastened on said rotation part, one blade of a group consisting of said live blade and said neutral blade is spaced at least 4.0 mm from an outer periphery of said rotation part, said rotary plug has a non-electrically connected fasten in secured in and extending outwardly from said rotation part and spaced apart from said ground pin;

wherein a back surface of said housing has a first lock hole, said rotary plug has a second lock hole at the location corresponding to said first lock hole, a screw is inserted through said first lock hole and said second lock hole and is connectable to a socket panel to selectively secure the housing to the socket panel.

10. The adaptor having rotary plug structure as claimed in claim 9, wherein a diameter of said rotary plug is 65.0 mm.

11. The adaptor having rotary plug structure as claimed in claim 10, wherein said socket panel at least includes two second sockets, each of said second sockets has a first blade hole, a second blade hole and a pin hole.

12. The adaptor having rotary plug structure as claimed in claim 11, wherein said ground pin is inserted in the pin hole of a first socket of the two second sockets of said socket panel and said fasten pin is inserted in the pin hole of a second socket of the two second sockets of said socket panel, said fasten pin is spaced at least 4.0 mm from an outer periphery of said rotation part.

13. The adaptor having rotary plug structure as claimed in claim 9, wherein one side of said housing is further formed with an accommodation structure, wherein said accommodation structure is an accommodation holder, one end of said accommodation holder is formed with a stop sheet thereby allowing said hand-held communication device to be supported.

14. The adaptor having rotary plug structure as claimed in claim 12, wherein a center point of said ground pin and a center point of said second lock hole are spaced apart 10.5 mm, a diameter of said first lock hole and a diameter of said second lock hole is 4.0 mm.

* * * * *